US006749126B1

(12) United States Patent
Ruehle

(10) Patent No.: US 6,749,126 B1
(45) Date of Patent: Jun. 15, 2004

(54) FUEL INJECTOR AND METHOD FOR ITS OPERATION

(75) Inventor: Wolfgang Ruehle, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/720,506

(22) PCT Filed: Dec. 2, 1999

(86) PCT No.: PCT/DE99/03867

§ 371 (c)(1),
(2), (4) Date: May 10, 2001

(87) PCT Pub. No.: WO00/65224

PCT Pub. Date: Nov. 2, 2000

(30) Foreign Application Priority Data

Apr. 27, 1999 (DE) ..... 199 18 976

(51) Int. Cl.[7] ..... B05B 17/04

(52) U.S. Cl. ..... 239/4; 239/5; 239/102.1; 239/102.2; 239/585.1; 239/584; 239/533.9

(58) Field of Search ..... 239/102.1, 102.2, 239/585.1, 583, 584, 533.2, 533.7, 533.9, 5, 4, 11; 251/129.06

(56) References Cited

U.S. PATENT DOCUMENTS

| | | | | |
|---|---|---|---|---|
| 4,501,406 A | | 2/1985 | Walter et al. | |
| 4,750,706 A | | 6/1988 | Schlagmueller | |
| 6,025,671 A | * | 2/2000 | Boecking | 310/369 |
| 6,400,066 B1 | * | 6/2002 | Sumrak et al. | 310/346 |

FOREIGN PATENT DOCUMENTS

| | | |
|---|---|---|
| DE | 17 51 543 | 8/1970 |
| DE | 195 19 192 | 6/1996 |
| DE | 195 38 791 | 4/1997 |
| DE | 196 24 006 | 12/1997 |
| DE | 197 43 299 | 4/1999 |
| JP | 62 191662 | 8/1987 |
| JP | 06 343273 | 12/1994 |
| JP | 8165967 | * 6/1996 |
| JP | 08 165967 | 6/1996 |

OTHER PUBLICATIONS

Niko Herakovic, "Analyzing the Use of the Piezoelectric Effect for Controlling Fluid Valves", TH Aachen 1996, pp. 75–77, Wissenschaftsverlag [Scientific Publishing House] Aachen, ISBN 3–89653–041–0.*

* cited by examiner

*Primary Examiner*—Robin O. Evans
(74) *Attorney, Agent, or Firm*—Kenyon & Kenyon

(57) ABSTRACT

A fuel injector, particularly an injection valve for fuel-injection systems of internal combustion engines, has a first piezoelectric or magnetostrictive actuator and a valve-closure member that can be actuated by the first actuator via a valve needle. The valve closure member interacts with a valve seat surface to form a sealing seat. A second piezoelectric or magnetostrictive actuator acts on the valve needle in opposition to the first actuator. In this context, the actuators are interconnected by a supporting element which is permanently mounted in the fuel injector.

12 Claims, 3 Drawing Sheets

FUEL INJECTOR AND METHOD FOR ITS OPERATION

FIELD OF THE INVENTION

The present invention relates to a fuel injector, and to a method for operating a fuel injector.

BACKGROUND INFORMATION

A fuel injector for fuel-injection systems of internal combustion engines is known from German Patent Application No. 195 38 791, where a valve-closure member that interacts with a valve-seat surface to form a sealing seat is controlled by an actuator, via a valve needle.

The principal problem in using piezoelectric actuators is their thermal expansion. In contrast to customary materials such as steel or plastics, the piezoelectric materials have a negative coefficient of thermal expansion. This causes the piezoelectric actuator to contract with increasing temperature, while the surrounding housing expands. The different thermal expansion coefficients of the piezoelectric actuator, on one hand, and the housing, on the other hand, produces a temperature-dependent valve lift when this is not compensated for by appropriate measures.

Temperature compensation for a first piezoelectric actuator by a second piezoelectric actuator is known from the dissertation of Niko Herakovic, "Die Untersuchung der Nutzung des Piezoeffektes zur Ansteuerung fluidtechnischer Ventile" ["Analyzing the Use of the Piezoelectric Effect for Controlling Fluid Valves"], TH Aachen 1996, pp. 75–77, Wissenschaftsverlag [Scientific Publishing House] Aachen, ISBN 3-89653-041-0. In this case, the two piezoelectric actuators are each accommodated in one housing. To compensate for temperature, the second piezoelectric actuator counteracts the first piezoelectric actuator on a cylinder disposed between the two piezoelectric actuators. The cylinder is raised as a function of the operating voltage of the first actuator. When the temperature of the two actuators is increased, then the thermal expansions of the two actuators compensate for each other.

A disadvantage of the temperature compensation known from this printed publication is that, in order to actuate a valve needle of the fuel injector, the valve needle must be connected, via a suitable connecting device, to the cylinder supported between the two actuators. Additional parts encompassing at least one of the actuators are necessary for this, which means that the width of the fuel injector increases. In addition, the actuators are spaced far apart from each other so that, in response to the first piezoelectric actuator warming up sharply as a result of operating conditions, the second actuator is not able to compensate for the thermal expansion of the first actuator. Even in long-term operation, the temperature gradient formed between the first piezoelectric actuator and the second piezoelectric actuator results in insufficient temperature compensation. In the exemplary embodiment of the dissertation, the temperature of the two actuators is actively adjusted by cooling or heating elements. In summary, this temperature compensation is costly and not suitable for practical use.

To compensate for temperature, German Patent Application No. 195 38 791 proposes designing the valve housing as two pieces made of different materials. For example, it is proposed that one housing part be manufactured from steel, and the other housing part be manufactured from Invar. By choosing a suitable length for the first housing part made of steel and the second housing part made of Invar, it is intended that the total, resulting thermal expansion of the housing be adapted to the thermal expansion of the piezoelectric actuator, and therefore, that the piezoelectric actuator and the housing encompassing the piezoelectric actuator expand in the same manner, as a function of temperature.

A disadvantage of this design approach is that the valve housing is difficult to manufacture, and the material for the second housing part, preferably Invar, is expensive. Furthermore, it must be taken into consideration, that the valve housing and the actuator can have different temperatures. Thus, the waste heat of the piezoelectric actuator, which especially results from frequent operation of the fuel injector, can heat up the piezoelectric actuator, and it can only transfer its temperature slowly to the valve housing. On the other hand, the temperature of the valve housing is affected by the waste heat of the internal combustion engine on which the fuel injector is mounted. Therefore, this type of temperature compensation is not satisfactory.

A fuel injector for fuel-injection systems of internal combustion engines is known from German Patent No. 195 19 192, where an actuator acts on a valve needle, via a hydraulic transmission system. The transmission device includes a primary piston having an inner opening, in which a secondary piston is moveably guided. The secondary piston is connected to a valve needle, which is sealingly and movably guided in the valve housing. In the valve housing is a working chamber, which is filled with fuel and delimited by the primary piston and the secondary piston. The piezoelectric actuator contacts the primary piston on the side of the primary piston opposite to the working chamber. Since the volume of the fuel-filled working chamber must be maintained, a movement of the primary piston due to the action of the piezoelectric actuator causes the secondary piston to move in the primary piston, a suitable stroke transmission ratio being given by appropriately dimensioning the surfaces on the primary piston and the secondary piston, on the side of the working chamber. The temperature compensation is attained through a defined slot between the primary piston and the secondary piston. To that end, a portion of the fuel can be expelled from the working chamber in response to a temperature-dependent, quasistatic expansion of the fuel in the working chamber.

A disadvantage of this design approach is that the hydraulic temperature compensation causes the action of the actuator to be transmitted to the valve needle in a damped manner, which increases the response time of the valve needle, and does not allow the fuel injector to be used as a rapid-actuation fuel injector.

SUMMARY OF THE INVENTION

In contrast, the fuel injector of the present invention has the advantage that the temperature compensation of the actuator is considerably better. In addition, the fuel injector according to the present invention can also be used as a rapid-actuation fuel injector. Further advantages lie in the precise adjustability of the course of injection, whereby the injection operation can be adjusted to the specific operating condition and the operating requirements of the internal combustion engine; and in the small number of mechanically movable components, so that the fuel injector is designed to have a low rate of wear, and is easy to construct.

It is advantageous when the supporting element lies against a shoulder formed in the valve housing. This can reduce the number of additional parts. In this case, the supporting element can rest against a shoulder formed in the valve housing, by means of an elastically deformable seat element. This allows the valve needle to sit centered in the sealing seat. In addition, abrupt pressure pulses acting on the valve needle can be absorbed, which means that stress on the valve needle is reduced.

It is also advantageous when a large, initial stress is applied to at least one of the actuators, which means that, in the case of non-actuated actuators, the valve needle is supported against the sealing seat, in the closed position, by a force given by the difference in initial stress. This can eliminate the need for an additional compression spring for pressing the valve needle into the sealing seat.

The supporting element is advantageously secured in the valve housing by a screw element, which allows the initial stress acting on at least one of the actuators to be adjusted. This allows the contact force of the valve needle in the sealing seat, and the opening force acting on the valve needle in the case of non-actuated actuators, to be discreetly adjusted. This is especially useful in connection with the elastically deformable seat element. This also allows the ratio of the initial stresses of the two actuators to be set.

The actuators are advantageously arranged in an oblong actuator housing, the actuator housing having at least one notch, which is laterally positioned on the actuator housing, and has an elongated design in the longitudinal direction of the actuator housing; the supporting element protruding through the notch, and being movable in the notch, in the longitudinal direction of the actuator housing. The actuator housing allows the two actuators to be prestressed, which has a favorable effect on the operational reliability of the fuel injector, since unfavorable tensile forces on the actuators are avoided. In addition, the actuators can be preassembled in the housing in a favorable manner. Using the notch having an elongated design, the actuator housing can also be guided through the supporting element in the valve housing.

It is also advantageous when the actuator housing includes a housing plate on the inflow side, a housing plate on the side of the sealing seat, and a tubular housing wall having the oblongly designed notch; at least one of the actuators acting on the valve needle, via at least one of the housing plates. This allows the actuator housing to be installed in the fuel injector in a compact manner, which results in a favorable transfer of force to the valve needle.

In response to a change in temperature, the actuator arranged on the one side of the supporting element advantageously undergoes an expansion, which is in the direction of the supporting element and compensates for an expansion of the actuator arranged on the other side of the supporting element, the latter expansion being in the direction of the supporting element, and being produced in response to the same temperature change. This attains a particularly effective temperature compensation.

The method of the present invention for operating a fuel injector, has the advantage that the closing and opening of the sealing seat can be actively controlled in both directions, without requiring additional components.

The valve needle advantageously closes in response to the second electrical operating voltage of the second actuator being switched off. This allows all of the energy used to actuate the first actuator to be used for closing the sealing seat, whereby the closing operation is simplified.

The sealing seat is advantageously opened up to a first opening cross-section by switching off the first operating voltage of the first actuator, while the second operating voltage of the second actuator is switched off. The sealing seat is opened up to a second opening cross-section by applying an electrical operating voltage to the second actuator, while the first operating voltage of the first actuator is switched off. This achieves a larger, two-stage valve-needle lift without the requirement of additional components.

DETAILED DESCRIPTION

Figure 1:
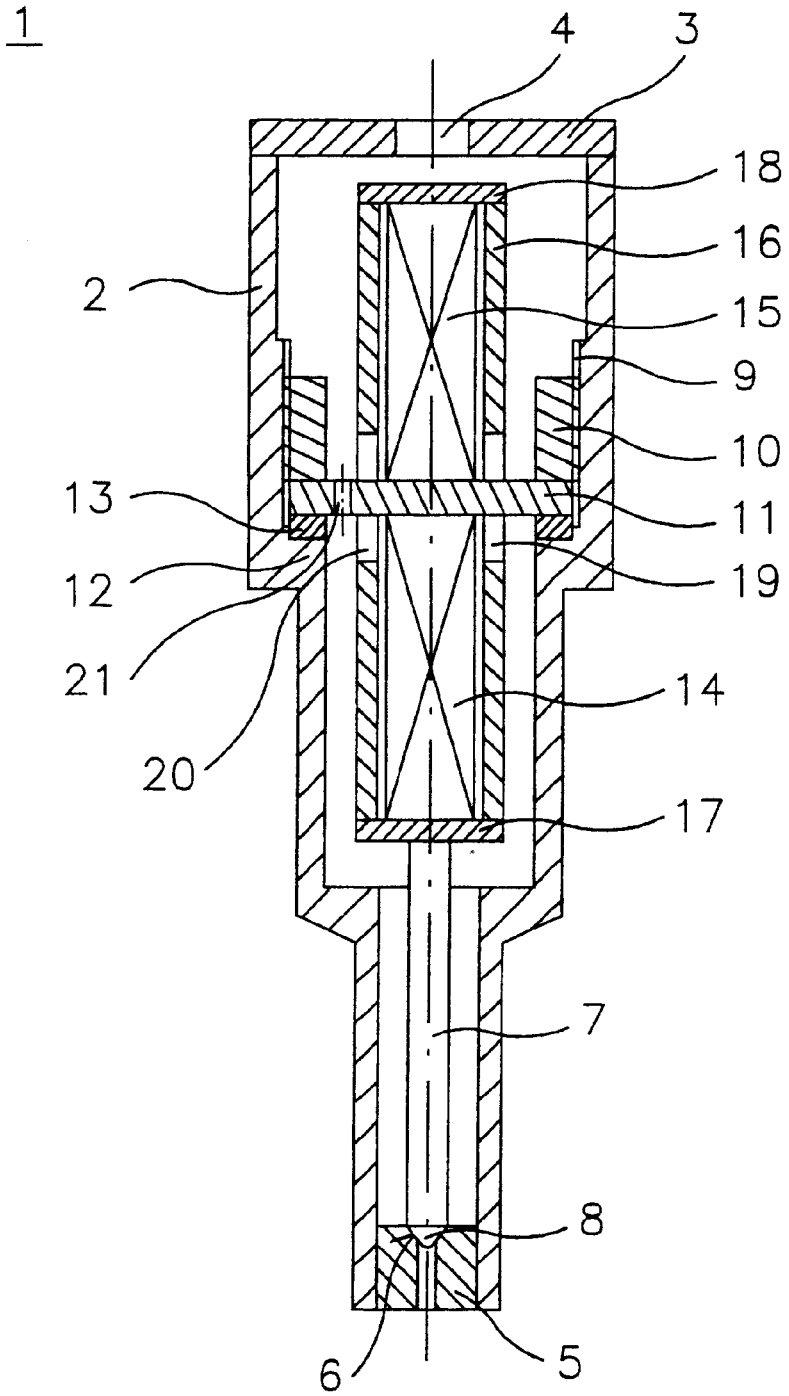
FIG. 1 shows an axial section through an exemplary embodiment of a fuel injector accroding to the present invention.

FIG. 1 shows an axial sectional view of a fuel injector 1 according to the present invention. Fuel injector 1 is particularly used as a so-called direct gasoline injector, for direct injection of fuel, especially gasoline, into a combustion chamber of a mixture-compressing, spark ignition engine. However, fuel injector 1 of the present invention is also suitable for other applications.

Fuel injector 1 has a valve housing 2 connected to a cover plate 3 on the inflow side, a fuel inlet 4 in cover plate 3 being represented in a simplified manner by a bore hole. A valve-seat member 5 having a valve-seat surface 6 is located at the ejection end of fuel injector 1. A valve needle 7 actuates a valve-closure member 8 which, in this exemplary embodiment, is formed as one piece with valve needle 7. Valve-closure member 8 is formed in the shape of a truncated cone and tapered in the ejection direction, and interacts with valve-seat surface 6 of valve-seat member 5 to form a sealing seat. An internal thread 9, in which a screw element 10 is screwed, is formed in the interior of valve housing 2, in order to fasten a supporting element 11 in valve housing 2 against an elastically deformable seat element 13 that rests on a shoulder 12 of valve housing 2. A first actuator 14 rests against the sealing-seat-side end face of supporting element 11, and a second actuator 15 rests against the inflow-side end face of supporting element 11. In this context, both actuators 14 and 15 are cylindrically shaped, and are enclosed by a tubular housing wall 16. The end face of first actuator 14 facing away from supporting element 11 abuts against a sealing-seat-side housing plate 17, which is connected to tubular housing wall 16. In the same manner, the end face of second actuator 15 opposite to supporting element 11 abuts on inflow-side housing plate 18, which is connected to tubular housing wall 16. Tubular housing wall 16 has notches 19, 20, through which supporting element 11 protrudes. Starting out from fuel inlet 4, the fuel is directed through, e.g. a bore hole 21 in supporting element 11, in the direction of the sealing seat.

To operate fuel injector 1, an electrical operating voltage is applied to piezoelectric or magnetostrictive, second actuator 15, which causes second actuator 15 to expand. Since second actuator 15 is supported at its sealing-seat-side end face, on supporting element 11, actuator housing 16, 17, 18 moves in the direction of cover plate 3, whereby valve needle 7 lifts valve-closure member 8 out of valve-seat member 5, and the sealing seat is opened. Fuel flows through the gap formed between valve-seat surface 6 of valve-seat member 5 and valve-closure member 8, out of fuel injector 1, and into the combustion chamber of the internal combustion engine. Valve-closure member 8 attached to valve needle 7 is reset by first actuator 14, valve needle 7 being permanently joined to housing plate 17. First actuator 14 is supported at its end face facing cover plate 3, on supporting element 11, whereby actuator housing 16–18 is moved in the direction of the sealing seat in response to an electrical operating voltage being applied to first actuator 14; and valve-closure member 8 is pressed onto valve-seat surface 6 of valve-seat member 5, which closes fuel injector 1. Valve needle 7 can also be reset by a suitable spring element, especially a compression spring, which is mounted in the interior of valve housing 2. It is also possible to reset valve-closure member 8 by switching off the electrical operating voltage of actuator 15. A pulse of the electrical operating voltage at actuator 14 can contribute to resetting the valve-closure member more rapidly.

Figure 2:
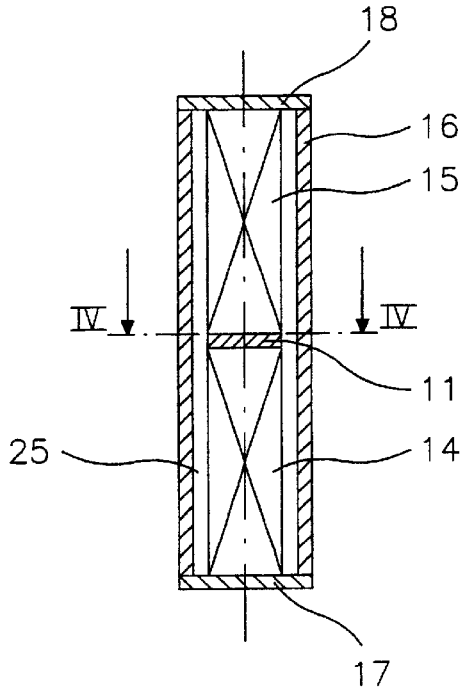
FIG. 2 shows an axial sectional view of the actuator housing shown in FIG. 1, having a side view of two actuators and a supporting element.
Figure 3:
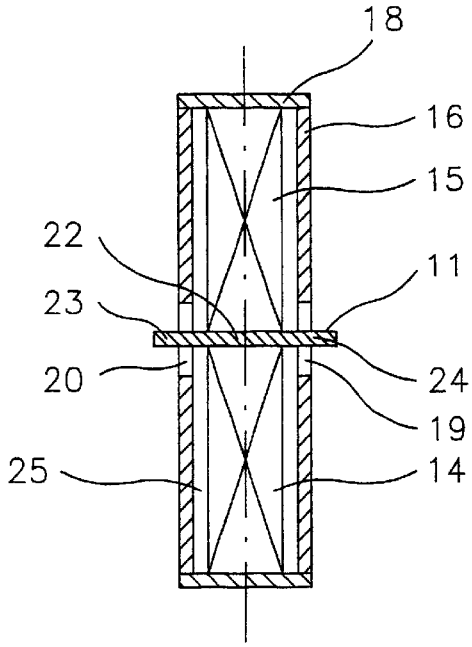
FIG. 3 shows a frontal sectional view of FIG. 2.
Figure 4:
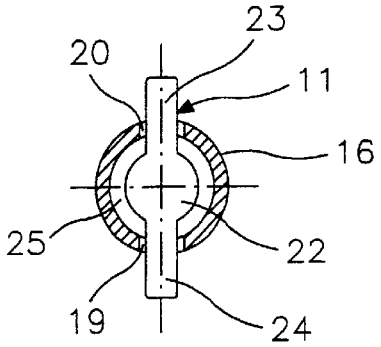
FIG. 4 shows a section along line IV—IV in FIG. 2.

FIGS. 2, 3, and 4 show actuator housing 16, 17, 18, in which both actuators 14, 15 and supporting element 11 are located.

Supporting element 11 has a circular region 22 and two extreme, oblongly formed regions 23, 24, which extend in diametric opposition to each other, at an angle of 180°. In this context, the shape of circular region 22 of supporting element 11 is adapted to the cross-section of both actuators 14, 15, so that actuators 14, 15 can be supported on supporting element 11, in a particularly favorable manner. Since actuators 14, 15 that shrink in the axial direction become slightly wider in the radial direction, gap 25 accommodating the radial expansion of actuators 14, 15 is provided between actuators 14, 15 and tubular housing wall 16. Supporting element 11 is movably guided in a notch 20 in oblong region 23 of supporting element 11. In the same manner, oblong region 24 of supporting element 11 is guided in a notch 19.

The present invention is not limited to the described exemplary embodiments. Another refinement of actuators 14, 15, supporting element 11, and actuator housing 16–18 is also conceivable. In particular, both actuators 14, 15 can be at least partially enclosed by the supporting element.

Figure 5:
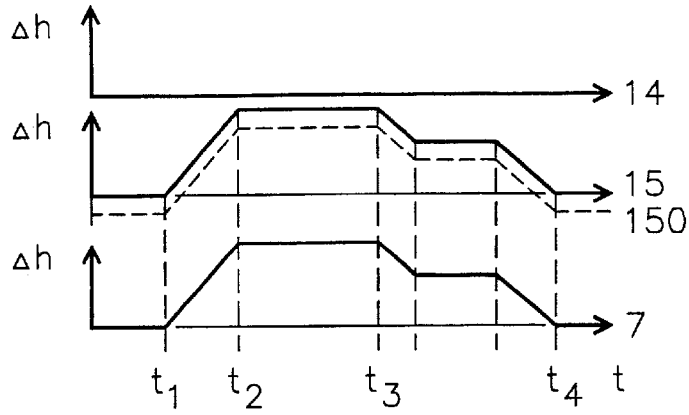
FIG. 5 shows a diagram for explaining temperature compensation.

In FIG. 5, the lift of valve needle 7 is represented as a function of the lift of second actuator 15, the lift of second actuator 15 being temperature-compensated by first actuator 14. In the diagram, the ordinate is lift Δh of both actuators 14, 15 and valve needle 7, and the abscissa is time t. In the represented example, first actuator 14 is exclusively used for temperature compensation, with the operating voltage switched off. At time t1, the operating voltage of second actuator 15 is switched on, whereby second actuator 15 expands, and attains a maximum expansion at time t2. Since the second actuator 15 acts on valve needle 7 without any interpositioning of damping elements, valve needle 7 follows the lift of second actuator 15, without any time delay. At time t3, the operating voltage of second actuator 15 is reduced until it is completely switched off at time t4. The lift of valve needle 7 follows the lift of second actuator 15. If the temperature of fuel injector 1 is now increased, then first actuator 14 counteracts the longitudinal expansion of second actuator 15, which causes the effective temperature lift to disappear. In contrast to an actuator 150 not compensated for temperature, where the actuator lift shifts by an amount attributable to thermal expansion, the lift characteristic of temperature-stabilized actuator 15 is unshifted, so that the same valve-needle lift of valve needle 7 is obtained independently of the temperature.

Figure 6:
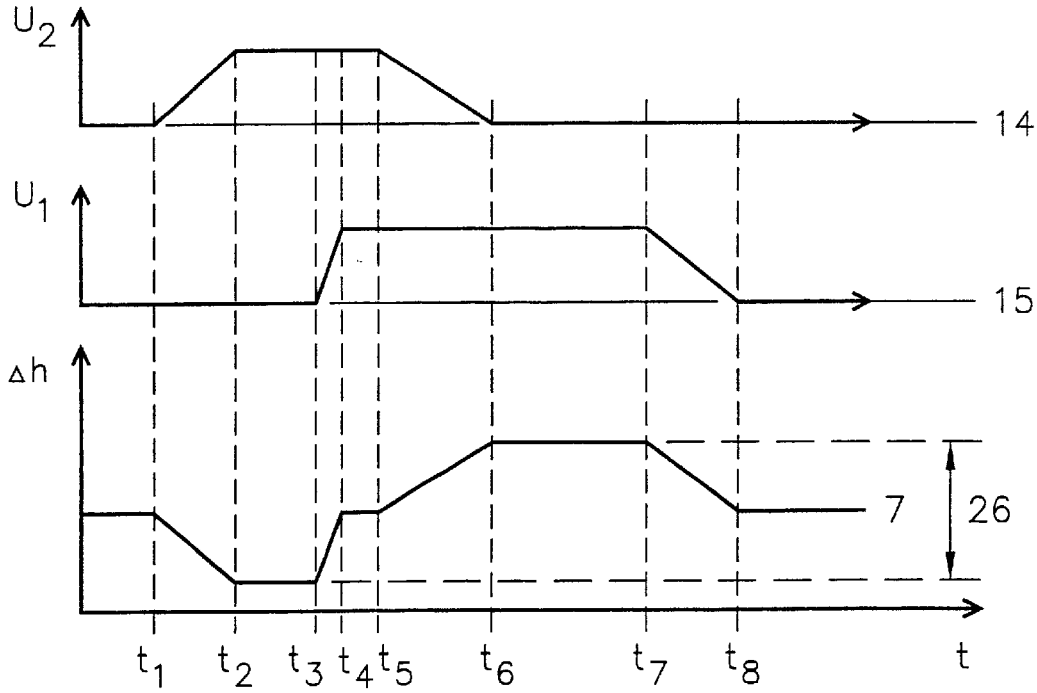
FIG. 6 shows a diagram in which valve-needle lift $\Delta h$ of the valve needle is represented as a function of a first operational voltage U1 of the first actuator, and a second operating voltage U2 of the second actuator.

In FIG. 6, valve lift Δh of valve needle 7 is represented as a function of an operating voltage U2 of first actuator 14, and as a function of a second operating voltage U1 of second actuator 15. In this context, voltages U1, U2 and valve-needle lift Δh are put on the ordinate, and time t is put on the abscissa. Up to time t1, operating voltage U2 of first actuator 14 and operating voltage U1 of second actuator 15 are switched off, whereby valve needle 7 is in a neutral position and opens up the sealing seat to a first opening cross-section. To close the sealing seat, an electrical operating voltage U2 is applied to first actuator 14 at time t1, first actuator 14 reaching a maximum lift at time t2, and the sealing seat being closed. Applying an electrical operating voltage U1 to second actuator 15 at time t3, while actuator voltage U2 of first actuator 14 remains unchanged, causes the sealing seat to open up to the first opening cross-section at time t4. As of time t5, operating voltage U2 of first actuator 14 is reduced, whereby the sealing seat opens up further, and reaches a second opening cross-section at time t6, when operating voltage U2 of first actuator 14 is switched off. Operating voltage U1 of second actuator 15 is reduced at time t7, whereby the opening cross-section of the sealing seat becomes smaller. It reaches the first opening cross-section again at time t8, when both operating voltages U1, U2 of both actuators 14, 15 are switched off. In comparison with operating the fuel injector, using only one of actuators 14, 15, a larger valve-needle lift 26 is attained. The two-stage design of the valve lift allows the dosed amounts to be varied.

I claim:

1. A fuel injector, comprising:

a first actuator of one of a piezoelectric and a magnetostrictive type;

a valve needle;

a valve seat surface;

a valve closure member, the valve closure member being activated by the first actuator via the valve needle, the valve closure member forming a sealing seat in interaction with the valve seat surface;

a second actuator of one of a piezoelectric and a magnetostrictive type, the second actuator acting on the valve needle in opposition to the first actuator; and a supporting element, the supporting element joining together the first and second actuators, the supporting element being permanently mounted in the fuel injector, wherein the supporting element includes a borehole through which fuel is directed.

2. The fuel injector of claim 1, wherein the injector is an injection valve for a fuel injection system of an internal combustion engine.

3. The fuel injector of claim 1, further comprising:

a valve housing, the valve housing including a shoulder formed in the housing;

wherein the supporting element rests against the shoulder.

4. The fuel injector of claim 3, further comprising:

an elastically deformable seat element;

wherein the supporting element rests against the shoulder via the deformable seat element.

5. The fuel injector of claim 1, wherein at least one of the first and second actuators is prestressed by the supporting element, and if the at least one of the first and second actuators is non-activated, the valve needle is held in a closed position by a force resulting from an initial stress.

6. The fuel injector of claim 5, further comprising:

a screw element, the screw element fastening the supporting element in the valve housing, a tightening torque of the screw element allowing the initial stress acting on at least one of the first and second actuators to be adjusted.

7. The fuel injector of claim 1, further comprising:

an oblong actuator housing in which the first and second actuators are situated, the actuator housing including at least one notch laterally situated on the actuator housing, the notch being oblong in a longitudinal direction of the actuator housing;

wherein the supporting element protrudes through the notch, the supporting element being movable in the notch in the longitudinal direction of the actuator housing.

8. The fuel injector of claim 7, wherein the actuator housing includes a first housing plate on an inflow side, a second housing plate on a sealing-seat side, and a tubular housing wall, the housing wall including the notch, at least one of the first and second actuators acting on the valve needle via at least one of the housing plates.

9. The fuel injector of claim 1, wherein the second actuator situated on one side of the supporting element undergoes a first expansion in the direction of the supporting element in response to a temperature change, the first expansion compensating for a second expansion of the first actuator on an opposite side of the supporting element, the second expansion being in the direction of the supporting element and in response to the temperature change.

10. A method of operating an injection valve, the valve including a valve needle, a valve seat surface, a first actuator of one of a piezoelectric and a magnetostrictive type, a valve closure member being actuated by the first actuator using the valve needle and forming a sealing seat with the seat surface, a second actuator of one of a piezoelectric and magnetostrictive type joined together with the first actuator, the second actuator acting on the valve needle in opposition to the first actuator, the method comprising the steps of:

closing the sealing seat by applying a first electrical operating voltage to the first actuator while a second electrical operating voltage of the second actuator is switched off; and opening the sealing seat by at least one of:

a) reducing the first electrical operating voltage; and b) applying the second electrical operating voltage to the second actuator.

11. The method of claim 10, further comprising the steps of:

switching off the first operating voltage of the first actuator to open the seat to a first opening cross section while the second operating voltage of the second actuator is switched off; and the second operating voltage to the second actuator to open the sealing seat to a second opening cross section while the first operating voltage of the first actuator is switched off, the second opening cross section being larger than the first opening cross section.

12. The method of claim 11, wherein the second opening cross section is twice as large as the first opening cross section.

* * * * *

UNITED STATES PATENT AND TRADEMARK OFFICE

CERTIFICATE OF CORRECTION

PATENT NO. : 6,749,126 B1
DATED : June 15, 2004
INVENTOR(S) : Wolfgang Ruehle

It is certified that error appears in the above-identified patent and that said Letters Patent is hereby corrected as shown below:

Column 8,
Line 23, change "the second operating voltage" to -- applying the second operating voltage --

Signed and Sealed this

Seventh Day of June, 2005

JON W. DUDAS
*Director of the United States Patent and Trademark Office*